US009368060B2

(12) United States Patent
Chae et al.

(10) Patent No.: US 9,368,060 B2
(45) Date of Patent: Jun. 14, 2016

(54) ORGANIC LIGHT EMITTING DISPLAY DEVICE USING AN ADJUSTABLE POWER SOURCE VOLTAGE AND DRIVING METHOD THEREOF

(71) Applicant: SAMSUNG DISPLAY CO., LTD., Yongin, Gyeonggi-Do (KR)

(72) Inventors: Se-Byung Chae, Yongin (KR); Wook Lee, Yongin (KR); Jeong-Hwan Shin, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 184 days.

(21) Appl. No.: 14/040,925

(22) Filed: Sep. 30, 2013

(65) Prior Publication Data

US 2014/0240305 A1 Aug. 28, 2014

(30) Foreign Application Priority Data

Feb. 27, 2013 (KR) ..... 10-2013-0021526

(51) Int. Cl.
*G09G 3/36* (2006.01)
*G09G 3/32* (2016.01)

(52) U.S. Cl.
CPC ..... *G09G 3/3225* (2013.01); *G09G 3/3696* (2013.01); *G09G 2320/0233* (2013.01); *G09G 2320/043* (2013.01); *G09G 2330/02* (2013.01); *G09G 2360/16* (2013.01)

(58) Field of Classification Search
CPC ..... G09G 3/3696; G09G 3/3225; G09G 2360/16; G09G 2330/02; G09G 2320/0233; G09G 2320/043–2320/045
USPC ..... 345/76–82, 204–215, 690–699
See application file for complete search history.

(56) References Cited

U.S. PATENT DOCUMENTS

2011/0169990 A1* 7/2011 Higuchi ..... H03M 1/664 348/302
2012/0056537 A1* 3/2012 Koyama ..... 315/51
2012/0139955 A1* 6/2012 Jaffari et al. ..... 345/690
2013/0083087 A1* 4/2013 Byun et al. ..... 345/690

FOREIGN PATENT DOCUMENTS

KR 10-2011-0070610 A 6/2011
KR 10-2011-0090303 A 8/2011
KR 10-2012-0013525 A 2/2012

* cited by examiner

*Primary Examiner* — Jimmy H Nguyen
*Assistant Examiner* — Yaron Cohen
(74) *Attorney, Agent, or Firm* — Lee & Morse, P.C.

(57) ABSTRACT

A power system for an organic light emitting diode (OLED) display includes a power supplier and a power source controller. The power supplier respectively supplies a first power source voltage and a second power source voltage to first and second power source voltage application lines. The power source controller calculates a reference power source voltage corresponding to a maximum average grayscale using a distribution for each grayscale of first to third image data, models each voltage drop of the first and second power source voltages for first to third subpixels, and reflects the voltage drop to the reference power source voltage to change the second power source voltage.

19 Claims, 8 Drawing Sheets

ORGANIC LIGHT EMITTING DISPLAY DEVICE USING AN ADJUSTABLE POWER SOURCE VOLTAGE AND DRIVING METHOD THEREOF

CROSS-REFERENCE TO RELATED APPLICATION

Korean Patent Application No. 10-2013-0021526, entitled "Organic Light Emitting Display Device and Driving Method Thereof", filed in the Korean Intellectual Property Office on Feb. 27, 2013, the entire contents of which are incorporated herein by reference.

BACKGROUND

1. Field

Embodiments relate to an organic light emitting diode (OLED) display and a driving method thereof.

2. Description of the Related Art

In a display device, a plurality of pixels are disposed in a matrix form on a substrate so as to be used as a display area, scan lines and data lines are connected to pixels, and data signals are selectively applied to the pixels to display an image.

Currently, display devices are divided into a passive matrix type of light emitting display device and an active matrix type of light emitting display device depending on how pixels are driven. Among them, the active matrix type of light emitting display device, in which unit pixels are selectively turned on, is becoming mainstream in terms of resolution, contrast, and operation speed.

Such a display device is used as a display device for mobile information terminals such as a personal computer, a mobile phone, a personal digital assistant (PDA), and the like, or as a monitor of various information devices, and a liquid crystal display (LCD) using a liquid crystal panel, an organic light emitting diode (OLED) display device using an organic light emitting element, a plasma display panel (PDP), and the like, are widely known as the display device. Among them, an OLED display device having excellent luminous efficiency, excellent luminance, a wide viewing angle, and a fast response speed, has received much attention.

In the case of the OLED display device, gray levels are represented by current flowing across an OLED and a driving transistor is used to control current supplied to the OLED. Operation regions of the driving transistor are divided into a saturation region and a linear region. In general, a source electrode of the driving transistor is fixed as a certain power source voltage and a data voltage input to a gate electrode of the driving transistor is changed according to a gray level.

Thus, in order for the driving transistor to control current supplied to the OLED according to a data voltage, the driving transistor must operate in the saturation region. If the driving transistor operates in the linear region, current flowing across the driving transistor would be changed according to a drain-source voltage, so even when the same data voltage is applied, a different current may be supplied to the OLED according to the driving transistor. In order for the driving transistor to operate in the saturation region, the drain-source voltage of the driving transistor must have a higher level than that of a certain saturation voltage.

Meanwhile, the driving voltage of the OLED changes according to the temperature of the display device or due to degradation of the OLED resulting from prolonged use of the display device with the passage of time. As the use time of the display device is lengthened, the driving voltage needs to be increased to apply the same current due to gradual degradation of the OLED itself. In addition, the driving voltage varies according to a change in temperature such as a low temperature, room temperature, and a high temperature.

The above information disclosed in this Background section is only for enhancement of understanding and therefore it may contain information that does not form the prior art that is already known in this country to a person of ordinary skill in the art.

SUMMARY

An organic light emitting diode (OLED) display including a plurality of data lines, a plurality of scan lines, and a plurality of pixels connected to a corresponding data line, a corresponding scan line, a first power source voltage application line, and a second power source voltage application line, wherein the plurality of pixels respectively include first to third subpixels emitting light according to first image data displaying a first color, second image data displaying a second color, and third image data displaying a third color according to an exemplary includes: a power supplier respectively supplying a first power source voltage and a second power source voltage to the first and second power source voltage application lines; and a power source controller calculating a reference power source voltage corresponding to a maximum average grayscale by using a distribution for each grayscale of the first to third image data, modeling each voltage drop of the first and second power source voltages for the first to third subpixels, and reflecting the voltage drop to the reference power source voltage to change the second power source voltage.

The power source controller may include: a histogram analyzer dividing a total grayscale number of the first to third image data into a plurality of regions and calculating an average grayscale value for each region for the first to third image data; a reference voltage setter calculating a saturation voltage value of the second power source voltage respectively corresponding to the average grayscale value and setting a lowest value among saturation voltage values as a reference power source voltage; a voltage drop calculator summing currents corresponding to remaining average grayscale values excluding the average grayscale value that is predetermined as the reference power source voltage to calculate a compensation current and generating an equivalent model of the first to third subpixels to calculate a resistance value of an equivalent resistor thereby calculating each voltage drop of the first and second power source voltages; and a power source voltage calculator reflecting the voltage drop to the reference power source voltage to calculate a predicted value of the second power source voltage.

A first lookup table storing an average grayscale value for each region for the first to third image data may be further included. A second lookup table storing the saturation voltage values of the second power source voltage for each grayscale for the first to third image data may be further included. A third lookup table storing a current value for each grayscale for the first to third image data may be further included.

The equivalent model includes: a first organic light emitting diode (OLED) light emitting the first color according to the first image data; a second organic light emitting diode (OLED) light emitting the second color according to the second image data; a third organic light emitting diode (OLED) light emitting the third color according to the third image data; first to third driving transistors respectively driving the first to third organic light emitting diodes (OLED); a top equivalent resistor commonly connected between the first power source voltage application line and the first to third driving transistors; and a bottom equivalent resistor commonly connected between the first to third organic light emitting diodes (OLED) and the second power source voltage application line.

The voltage drop calculator may calculate a ratio of a current that is a sum of second to fourth currents flowing when light emitting the first to third organic light emitting diodes (OLED) with a first grayscale for a first current flowing when simultaneously light emitting the first to third organic light emitting diodes (OLED) with the first grayscale as a top voltage drop ratio by the top equivalent resistor.

The voltage drop calculator may calculate the first to third driving currents by multiplying the top voltage drop ratio by the second to fourth currents and may calculate a resistance value of the bottom equivalent resistor by using the saturation voltage values of the second power source voltage respectively corresponding to the first to third driving currents, and the first to third driving currents. The voltage drop calculator may divide a voltage value that is equivalent to the saturation voltage value of the second power source voltage corresponding to the first grayscale subtracted from a highest saturation voltage value among the saturation voltage values of the second power source voltage respectively corresponding to the first to third driving currents by a sum of the remaining driving currents excluding the driving current corresponding to the highest saturation voltage value among the first to third driving currents to calculate a resistance value of the bottom equivalent resistor.

The voltage drop calculator may multiply the compensation current by the resistance value of the bottom equivalent resistor to calculate the voltage drop value by the bottom equivalent resistor. The voltage drop calculator may calculate the total voltage drop value by multiplying the voltage drop ratio by the voltage drop value by the bottom equivalent resistor. The voltage drop calculator may calculate a voltage that is decreased by the total voltage drop value to the reference power source voltage as a predicted value of the second power source voltage.

A method of driving an organic light emitting diode (OLED) display including a plurality of data lines, a plurality of scan lines, and a plurality of pixels connected to a corresponding data line, a corresponding scan line, a first power source voltage application line, and a second power source voltage application line, wherein the plurality of pixels respectively include first to third subpixels emitting light according to first image data displaying a first color, second image data displaying a second color, and third image data displaying a third color according to another exemplary embodiment includes: sensing the second power source voltage and applying it to the second power source voltage application line; calculating a reference power source voltage corresponding to a maximum average grayscale by using a distribution of each grayscale of the first to third image data; modeling each voltage drop of the first and second power source voltages for the first to third subpixels; and reflecting the voltage drop to the reference power source voltage to change the second power source voltage.

Calculating the reference power source voltage may include: dividing a total grayscale number of the first to third image data into a plurality of regions; calculating an average grayscale value for each region for the first to third image data; calculating the saturation voltage values of the second power source voltage respectively corresponding to the average grayscale value; and setting a lowest value among the saturation voltage values as the reference power source voltage.

Modeling the voltage drop may include: calculating a compensation current by summing currents corresponding to remaining average grayscale values excluding the average grayscale value that is predetermined as the reference power source voltage; generating an equivalent model of the first to third subpixels; and calculating each voltage drop of the first and second power source voltages by calculating a resistance value of an equivalent resistor for the equivalent model.

The equivalent resistor may include a top equivalent resistor positioned between the first power source voltage application line and the equivalent models of the first to third subpixels, and a bottom equivalent resistor positioned between the equivalent models of the first to third subpixels and the second power source voltage application line, and the calculating of the voltage drop may include calculating a ratio of a current sum of second to fourth currents flowing when respectively light emitting the first to third subpixels with a first grayscale for the first current flowing when simultaneously light emitting the first to third subpixels with the first grayscale as a top voltage drop ratio by the top equivalent resistor.

Calculating the voltage drop may include: multiplying the top voltage drop ratio by the second to fourth currents to respectively calculate the first to third driving currents; calculating the saturation voltage value of the second power source voltage respectively corresponding to the first to third driving currents; and dividing the voltage that is equivalent to the saturation voltage value of the second power source voltage corresponding to the first grayscale subtracted from the highest saturation voltage value among the saturation voltage values of the second power source voltage respectively corresponding to the first to third driving currents by the sum of remaining driving currents excluding a driving current corresponding to the highest saturation voltage value among the first to third driving currents to calculate the resistance value of the bottom equivalent resistor.

Calculating the voltage drop may include: multiplying the compensation current and the resistance value of the bottom equivalent resistor to calculate the voltage drop value by the bottom equivalent resistor; and multiplying the voltage drop ratio to the voltage drop value by the bottom equivalent resistor to calculate the total voltage drop value.

Changing the second power source voltage may include calculating a voltage that is decreased by the total voltage drop value to the reference power source voltage as a predicted value of the second power source voltage and reflecting the predicted value to the sensed second power source voltage.

An exemplary embodiment of relates to a power source voltage supplying device and a method thereof of an organic light emitting diode (OLED) display, and the driving voltage corresponding to the image data is predicted in real time to supply the optimized power source voltages such that the driving voltage margin may be obtained and the power consumption may be reduced.

DETAILED DESCRIPTION

Figure 1:
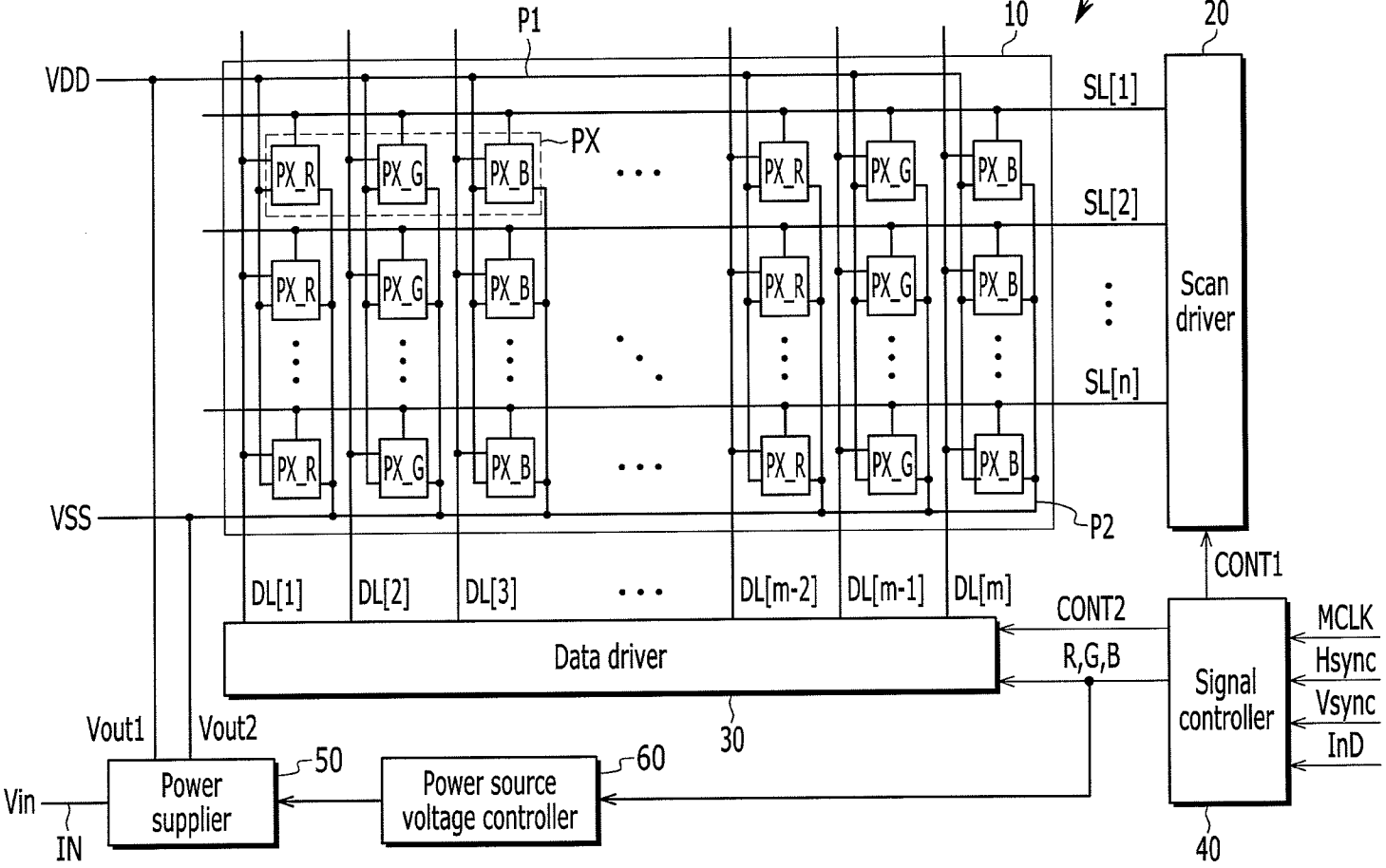
FIG. 1 is a view of an organic light emitting diode (OLED) display according to an exemplary embodiment.

In the following detailed description, only certain exemplary embodiments have been shown and described, simply by way of illustration. As those skilled in the art would realize, the described embodiments may be modified in various different ways, all without departing from the spirit or scope of the present disclosure. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a view of an organic light emitting diode (OLED) display according to an exemplary embodiment. Referring to FIG. 1, an organic light emitting diode (OLED) display 1 according to an exemplary embodiment includes a display panel 10, a scan driver 20, a data driver 30, a signal controller 40, a power supplier 50, and a power source controller 60. The display panel 10 is a display area that includes a plurality of pixels PX, a plurality of scan line SL[1]-SL[n], a plurality of data lines DL[1]-DL[m], a first power source voltage application line P1, and a second power source voltage application line P2.

The plurality of pixels PX may respectively include a red subpixel PX_R emitting red light, a green subpixel PX_G emitting green light, and a blue subpixel PX_B emitting blue light. The plurality of pixels PX may be arranged in an approximate matrix. The plurality of scan lines SL[1]-SL[n] are disposed in an approximate row direction in parallel, and the plurality of data lines DL[1]-DL[m] are disposed in an approximate column direction in parallel. The first and second power source voltage application lines P1 and P2 are respectively connected to the plurality of pixels PX.

Figure 2:
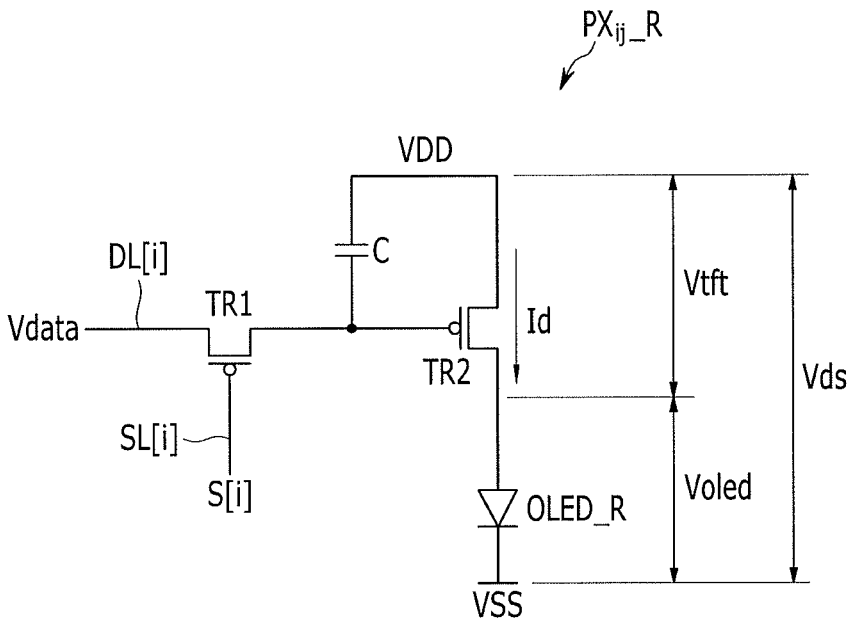
FIG. 2 is an equivalent circuit of a pixel PX according to an exemplary embodiment.

For example, a red subpixel PXij_R connected to an i-th scan line SL[i] and a j-th data line DL[j] among a plurality of pixels PX, as shown in FIG. 2, includes a switching transistor TR1, a driving transistor TR2, a capacitor C, and a red organic light emitting diode (OLED) OLED_R. The switching transistor TR1 includes a gate electrode connected to the scan line SL[i], a source electrode connected to the data line DL[j], and a drain electrode connected to the gate electrode of the driving transistor TR2.

The driving transistor TR2 includes a source electrode connected to the first power source voltage application line P1 to receive a first power source voltage VDD, a drain electrode connected to the anode of the red organic light emitting diode (OLED) OLED_R, and a gate electrode transmitted with the data signal Vdata during a period in which the switching transistor TR1 is turned on.

The capacitor C is connected to the gate electrode and the source electrode of the driving transistor TR2. The cathode of the red organic light emitting diode (OLED_R) is connected to the second power source voltage application line P2 to receive the second power source voltage VSS.

In the pixel PX having these constitutions, if the switching transistor TR1 is turned on by the scan signal S[i], the data signal data[j] is transmitted to the gate electrode of the driving transistor TR2. The voltage difference between the gate electrode and the source electrode of the driving transistor TR2 is maintained by the capacitor C and the driving current Id flows to the driving transistor TR2. The organic light emitting diode (OLED) emits light according to the driving current.

Again referring to FIG. 1, the scan driver 20 is connected to the scan lines SL[1]-SL[n] and generates a plurality of scan signals S[1]-S[n] according to the first driving control signal CONT1. The scan driver 20 transmits the scan signals S[1]-S[n] to the corresponding scan lines SL[1]-SL[n].

The data driver 30 processes red, green, and blue image data R, G, and B according to the second driving control signal CONT2 to be suitable for the display panel 10 to generate a plurality of data signals D[1]-D[m]. The plurality of data signals D[1]-D[m] include a plurality of red data signals respectively corresponding to the plurality of red subpixels PX_R, a plurality of blue data signals respectively corresponding to the plurality of blue subpixel PX_B, and a plurality of green data signals respectively corresponding to the plurality of green subpixels PX_G.

The signal controller 40 receives external input data InD and a synchronization signal, and generates the first driving control signal CONT1, the second driving control signal CONT2, and the red, green, and blue image data R, G, and B.

The synchronization signal may include a horizontal synchronization signal Hsync, a vertical synchronization signal Vsync, and a main clock signal MCLK. The signal controller 40 may divide the external input data InD by a frame unit according to the vertical synchronization signal Vsync. The signal controller 40 may divide the external input data InD by the scan line unit according to the horizontal synchronization signal Hsync to generate the red, green, and blue image data R, G, and B.

The power supplier 50 receives the input voltage Vin from the input terminal IN to generate the first and second power source voltages VDD and VSS, and outputs the first and second power source voltages VDD and VSS through the first and second output terminals Vout1 and Vout2. The first output terminal Vout1 is connected to the first power source voltage application line P1 and the second output terminal Vout2 is connected to the second power source voltage application line P2. The power supplier 50 may include a DC-DC converter.

The power source controller 60 calculates a reference power source voltage VSS_basic corresponding to a maximum average grayscale using a distribution of the red, green, and blue image data R, G, and B for each grayscale, models each voltage drop value of the first power source voltage VDD and the second power source voltage VSS, and reflects a voltage drop to the reference power source voltage VSS_basic to predict the optimized second power source voltage VSS. The power source controller 60 senses the second power source voltage VSS and changes the detected second power source voltage VSS into the second power source voltage VSS that is predicted in real time.

In detail, the power source controller 60 divides a total number of grayscales of the red, green, and blue image data R, G, and B into a plurality of regions and converts the average grayscale value for each region for each of the red, green, and blue image data R, G, and B into a saturation voltage value of the second power source voltage VSS.

The power source controller 60 may set the highest value among the converted saturation voltage values as the reference power source voltage VSS_basic and reflect a voltage drop by the common resistor modeled between the first power source voltage application line P1 and the second power source voltage application line P2 to the reference power source voltage VSS_basic to predict the optimized second power source voltage VSS.

The power source controller 60 according to an exemplary embodiment fixes the first power source voltage VDD and controls the second power source voltage VSS, however an exemplary embodiments are not limited thereto.

Figure 3:
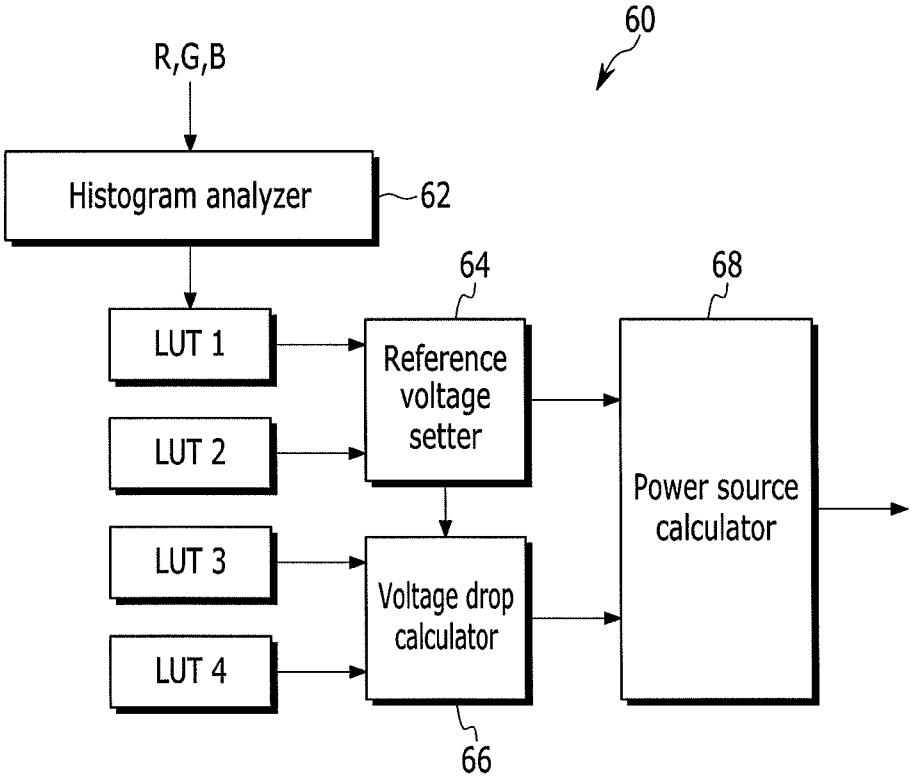
FIG. 3 is a detailed block diagram of the power source controller 60 shown in FIG. 1.

FIG. 3 is a detailed block diagram of the power source controller 60 shown in FIG. 1. Referring to FIG. 3, the power source controller 60 includes a histogram analyzer 62, a reference voltage setter 64, a voltage drop calculator 66, a power source voltage calculator 68, and first to fourth lookup tables LUT1-LUT4. The histogram analyzer 62 generates a histogram for the distribution for each grayscale of the red, green, and blue image data R, G, and B.

When the red, green, and blue image data R, G, and B are 8 bit data, the histogram analyzer 62 may expand the data to 10 bits by applying a 2.2 gamma and then generates the histogram.

The histogram analyzer 62 divides the total grayscale number of the red, green, and blue image data R, G, and B into a plurality of regions and calculates the average grayscale value for each region for each of the red, green, and blue histograms. The histogram analyzer 62 may calculate an intermediate grayscale value corresponding to the average of the distribution area for each region for the red, green, and blue image data R, G, and B as an average grayscale value. Also, each range of the plurality of regions may have a different size. The histogram analyzer 62 may store the average grayscale value for each region of the red, green, and blue histogram to the first lookup table LUT1.

The reference voltage setter 64 calculates the saturation voltage value of the second power source voltage VSS corresponding to the average grayscale value for each region for the red, green, and blue histograms stored the first lookup table LUT1. The saturation voltage value is the second power source voltage VSS corresponding to a drain-source voltage Vtft of a boundary position of a linear region and a saturation region in a characteristic curve between the drain-source voltage Vtft and the drain current Id of the driving transistor TR2 shown in FIG. 2. For example, the saturation voltage value may be determined to correspond to the boundary position at an SP position shown in FIG. 8 that will be described later.

Figure 4:
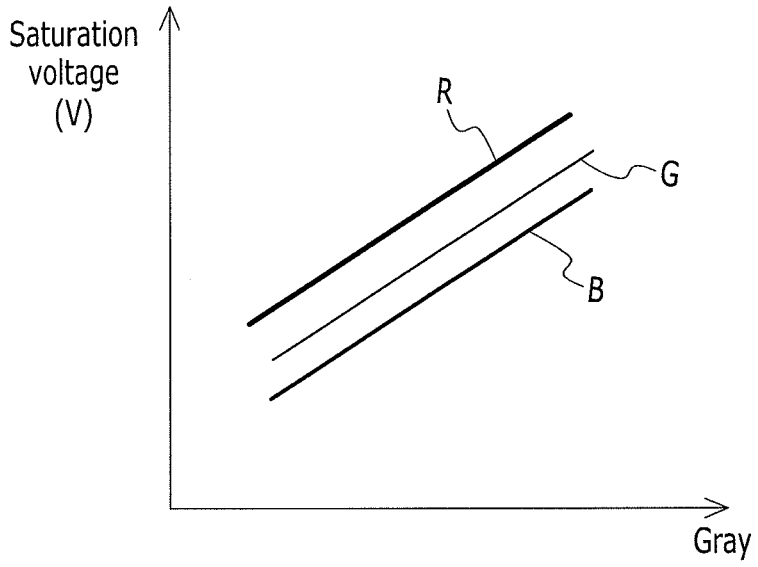
FIG. 4 is a view to explain the second lookup table LUT2 shown in FIG. 3.

The second lookup table LUT2 stores the saturation voltage value of the second power source voltage VSS for each grayscale that is previously measured for each of the red, green, and blue image data R, G, and B, as shown in FIG. 4. That is, the reference voltage setter 64 may subtract the saturation voltage value of the second power source voltage VSS respectively corresponding to the calculated average grayscale value from the second lookup table LUT2 from the average grayscale value from the first lookup table LUT1 to normalize the saturation voltage values. The reference voltage setter 64 may set the lowest value among the normalized saturation voltage values as the reference power source voltage VSS_basic.

Figure 5:
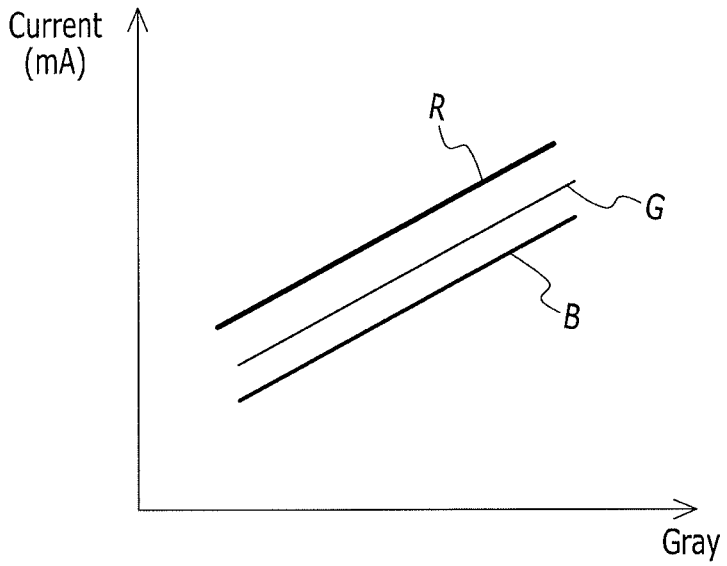
FIG. 5 is a view to explain the third lookup table LUT3 shown in FIG. 3.

The voltage drop calculator 66 may add the currents corresponding to remaining average grayscale values except for the color and the region corresponding to the reference power source voltage VSS_basic. Hereafter, the summed current value is referred to as a compensation current I_drop. The third lookup table LUT3 stores the current value for each grayscale that is respectively measured for the red, green, and blue image data R, G, and B, as shown in FIG. 5.

The voltage drop calculator 66 may generate the entire equivalent model for a plurality of pixels PX included in the display panel 10 and calculate the voltage drop by using the equivalent model. The equivalent model may be stored in the fourth lookup table LUT4.

Figure 6:
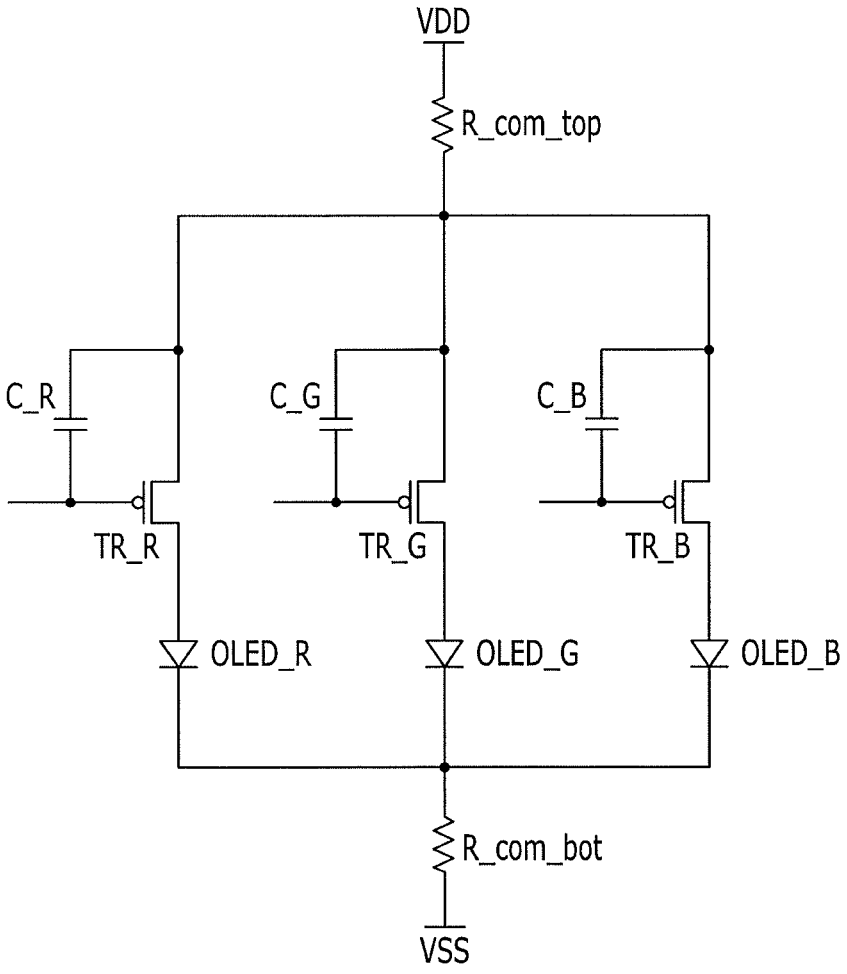
FIG. 6 is a view to explain an equivalent model for a pixel PX according to an exemplary embodiment.

In detail, as shown in FIG. 6, the voltage drop calculator 66 may be modeled as capacitors C_R, C_G, and C_B, driving transistors TR_R, TR_G, and TR_B, and the red, green, and blue organic light emitting diodes OLED_R, OLED_G, and OLED_B for a plurality of red, green, and blue subpixels PX_R, PX_G, and PX_B, includes the models of the red, green, and blue subpixels PX_R, PX_G, and PX_B, a top equivalent resistor R_com_top, and a bottom equivalent resistor R_com_bot. Thus, the voltage drop calculator 66 generates the equivalent model for a plurality of pixels PX.

The top equivalent resistor R_com_top may be a line resistor between the first power source voltage application line P1 and the driving transistors TR_R, TR_G, and TR_B, and may actually reduce currents respectively flowing to the red, green, and blue organic light emitting diodes OLED_R, OLED_G, and OLED_B. That is, the voltage difference between the gate and the source of the driving transistors TR_R, TR_G, and TR_B is reduced by the voltage drop due to the top equivalent resistor R_com_top.

The bottom equivalent resistor R_com_bot may be a line resistor between the red, green, and blue organic light emitting diodes OLED_R, OLED_G, and OLED_B, and the saturation voltage value of the second power source voltage VSS. Thus, the voltage difference may be reduced by the voltage drop due to the bottom equivalent resistor R_com_bot.

Accordingly, the voltage drop calculator 66 according to an exemplary embodiment calculates the total voltage drop VSS_drop by reflecting voltage drops due to the top equivalent resistor R_com_top and the bottom equivalent resistor R_com_bot.

The power source voltage calculator 68 calculates a predicted value of the second power source voltage VSS by reflecting the total voltage drop VSS_drop output from the voltage drop calculator 66 in the reference power source voltage VSS_basic output from the reference voltage setter 64. The power source voltage calculator 68 may actually sense the second power source voltage VSS applied to the second power source voltage application line P2 and change the sensed power source voltage VSS into the predicted value.

For this, the power source voltage calculator 68 may include a sensing resistor (not shown) connected to the second power source voltage application line P2. The power source voltage calculator 68 may sense the current flowing to both ends of the sensing resistor to sense the second power source voltage VSS and may digitally convert the sensed second power source voltage VSS through an analog-digital converter (not shown).

In this case, the power source voltage calculator 68 digitally converts the predicted value of the calculated second power source voltage VSS and generates information corresponding to a difference between the sensing value and the predicted value of the second power source voltage VSS into digital data. This difference is provided to the power supplier 50.

Next, a method of supplying the power source voltage according to an exemplary embodiment will be described.

Figure 7:
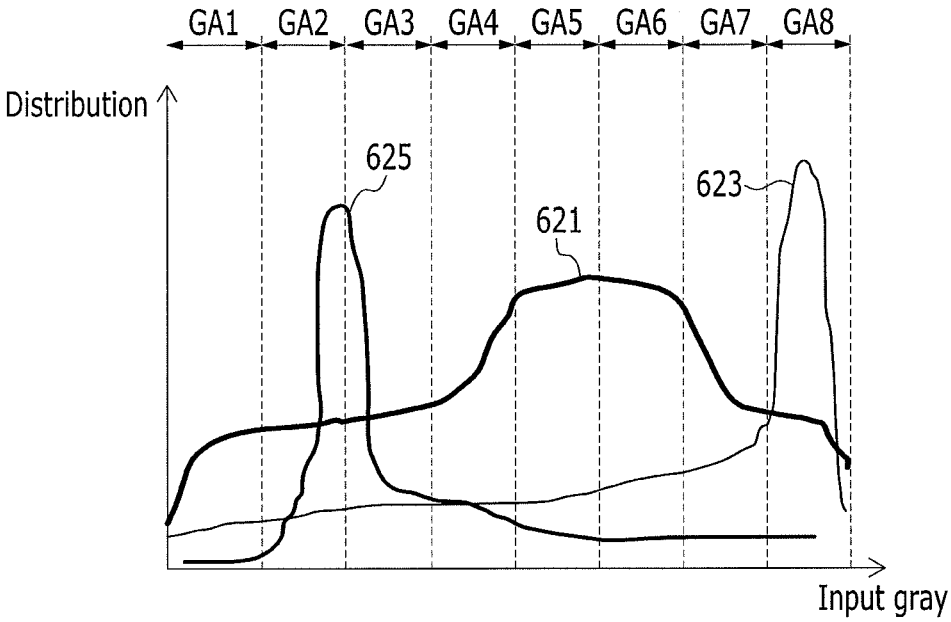
FIG. 7 is a red, green, and blue histogram according to an exemplary embodiment.

First, as shown in FIG. 7, the histogram analyzer 62 generates a red histogram 621 for the distribution for each grayscale of the red image data R, a green histogram 623 for the distribution for each grayscale of the green image data G, and a blue histogram 625 for the distribution for each grayscale of the blue image data B. The histogram analyzer 62 divides the input grayscale into eight regions GA1-GA8. In an exemplary embodiment, the grayscale is divided into eight regions. However, the grayscale may be divided into more or less than eight regions.

The histogram analyzer 62 calculates the average grayscale value for each of the regions GA1-GA8 for the red, green, and blue histograms 621, 623, and 625, and outputs these values to be stored in the first lookup table LUT1. That is, 24 average grayscale values that are divided into the color and the region are stored to the first lookup table LUT1.

Next, the reference voltage setter 64 subtracts the saturation voltage values of the second power source voltage VSS respectively corresponding to the 24 average grayscale values from the second lookup table LUT2. The lowest value among the saturation voltage values is set as the reference power source voltage VSS_basic.

Next, the voltage drop calculator 66 subtracts the currents corresponding to the 24 average grayscale values from the third lookup table LUT3. Next, the voltage drop calculator 66 adds the remaining 23 current values excluding one average grayscale value corresponding to the reference power source voltage VSS_basic among the 24 average grayscale values to calculate the compensation current I_drop.

Next, the voltage drop calculator 66 calculates a full white current I_white corresponding to the saturation voltage value of the second power source voltage VSS for full white image data of a 255 grayscale. Next, the voltage drop calculator 66 calculates a red current I_r, a green current I_g, and a blue current I_b corresponding to the saturation voltage value of the second power source voltage VSS for each of the red image data, the green image data, and the blue image data of the 255 grayscale.

Next, the voltage drop calculator 66 divides the full white current I_white by adding the red, green, and blue currents I_r, I_g, and I_b to calculate a top voltage drop ratio by the top equivalent resistor R_com_top for the entire voltage drop. That is, the voltage drop calculator 66 determines the ratio of the current flowing when the red, green, and blue organic light emitting diodes OLED_R, OLED_G, and OLED_B simultaneously emit light to display the full white current I_white, e.g., with the 255 grayscale, to current flowing when the red, green, and blue organic light emitting diodes OLED_R, OLED_G, and OLED_B respectively emit light to display the red, green and blue image corresponding to the 255 grayscale value, as a top voltage drop ratio by the top equivalent resistor R_com_top. voltage drop calculator Next, the voltage drop calculator 66 respectively reflects the top voltage drop ratio to the red current I_r, the green current I_g, and the blue current I_b to respectively calculate the red, green, and blue driving currents Id_r, Id_g, and Id_b that are predicted to respectively flow to the red, green, and blue organic light emitting diodes OLED_R, OLED_G, and OLED_B when actually being driven.

The voltage drop calculator 66 calculates the saturation voltage values of the second power source voltage VSS respectively corresponding to the red, green, and blue driving currents Id_r, Id_g, and Id_b, and selects a highest voltage value among the calculated saturation voltage values.

A voltage equivalent to the highest saturation voltage value is subtracted from the saturation voltage value of the second power source voltage VSS for the full white image data, e.g., 255 grayscale, is calculated. For example, when the saturation voltage value of the second power source voltage VSS corresponding to the red driving current Id_r is highest, the saturation voltage value of the second power source voltage VSS corresponding to the red driving current Id_r is subtracted from the saturation voltage value of the second power source voltage VSS for the full white image data of the 255 grayscale.

Next, the voltage drop calculator 66 calculates a resistance value of the bottom equivalent resistor R_com_bot by using Ohms law (V=IR). That is, the sum of the green driving current and the blue driving current Id_g and Id_b, i.e., excluding the red driving current Id_r selected from the voltage value of which the saturation voltage value of the second power source voltage VSS corresponding to the red driving current Id_r, is subtracted from the saturation voltage value of the second power source voltage VSS for the full white image data of the 255 grayscale is divided to calculate the resistance value of the bottom equivalent resistor R_com_bot.

Next, the voltage drop calculator 66 multiplies the compensation current I_drop by the resistance value of the bottom equivalent resistor R_com_bot to calculate the bottom voltage drop value by the bottom equivalent resistor R_com_bot. The top voltage drop ratio is multiplied by the bottom voltage drop value to calculate the total voltage drop VSS_drop that is reflected by a current decreasing amount by the top equivalent resistor R_com_top. Then, the power source voltage calculator 68 reflects the total voltage drop VSS_drop to the reference power source voltage VSS_basic to calculate the predicted value of the second power source voltage VSS.

Figure 8:
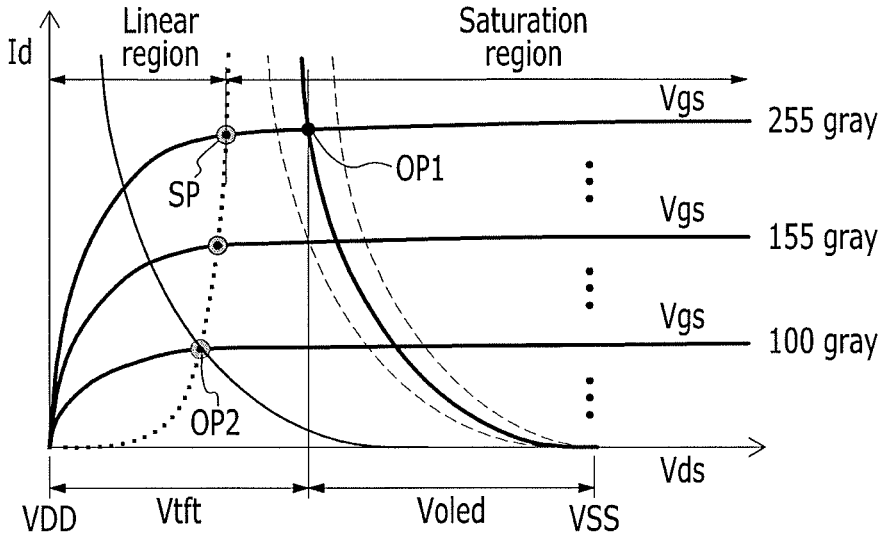
FIG. 8 is a view to explain an effect of a power source control method according to an exemplary embodiment.

That is, in the method supplying the power source voltage according to an exemplary embodiment, as shown in FIG. 8, when one maximum grayscale among the input red, green, and blue image data R, G, and B is changed from the 255 grayscale to the 100 grayscale, the optimized second power source voltage VSS is predicted as −2.0 V, and the second power source voltage VSS that is currently −4.0 V is changed to −2.0 V. Accordingly, the driving margin for the driving transistor included in each pixel PX is increased from the saturation voltage value OP1 at the 255 grayscale to the saturation voltage value OP2 at the 100 grayscale. Also, the power consumption may be reduced compared with a method of fixing and supplying the second power source voltage VSS.

According to one or more embodiments, a power source voltage supplying device and a method thereof of an organic light emitting diode (OLED) display, and the driving voltage corresponding to the image data is predicted in real time to supply the optimized power source voltages such that the driving voltage margin may be obtained and the power consumption may be reduced.

In the related art OLED display, power source voltages are set to have a sufficient margin so that even when the driving voltage of the OLED is changed, the drain-source voltage level of the driving transistor is higher than the saturation voltage level. Power voltages refer to voltages supplied to both ends when the driving transistor and the OLED are connected in series by circuitry. In general, the power source voltages are set with reference to a full white state in which the organic light emitting diode (OLED) emits light with a maximum grayscale. For example, when the image input to the organic light emitting diode (OLED) display is displayed with 0-255 grayscale levels, the power source voltages are set as the saturation voltage corresponding to a 255 grayscale. Since the power source voltages are set with reference to the full white state regardless of the image data input to the organic light emitting diode (OLED) display, when the data of a low grayscale such as a full black state is input, unnecessary power consumption is increased.

In contrast, according to embodiments, the driving margin for the driving transistor included in each pixel PX may be increased by reducing a second power source voltage from a value needed for a full, e.g., 255, grayscale image to that needed for a current grayscale image. Thus, the power consumption may be reduced compared with a method of fixing and supplying the second power source voltage.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting diode (OLED) display including a plurality of data lines, a plurality of scan lines, and a plurality of pixels connected to a corresponding data line, a corresponding scan line, a first power source voltage application line, and a second power source voltage application line, wherein the plurality of pixels respectively include first to third subpixels emitting light according to first image data for a first color, second image data for a second color, and third image data for a third color, comprising:

a power supplier respectively to supply a first power source voltage and a second power source voltage to the first and second power source voltage application lines; and a power source controller to calculate a reference power source voltage corresponding to a maximum average grayscale by using a distribution for each grayscale of the first to third image data, to calculate a ratio of a current that is a sum of second to fourth currents flowing respectively through the first to third subpixels when the first to third subpixels respectively emit light having a first grayscale value to a first current flowing through the first to third subpixels when the first to third subpixels simultaneously emit light with the first grayscale value, to model a first voltage drop of the first power source voltage and a second voltage drop of the second power source voltage for the first to third subpixels and to reflect the first and second voltage drops to the reference power source voltage to change the second power source voltage.

2. The organic light emitting diode (OLED) display of claim 1, wherein the power source controller includes:

a histogram analyzer to divide a total grayscale number of the first to third image data into a plurality of regions and calculates an average grayscale value for each region for the first to third image data;

a reference voltage setter to calculate a saturation voltage value of the second power source voltage respectively corresponding to the average grayscale value and sets a lowest value among saturation voltage values as the reference power source voltage;

a voltage drop calculator to add currents corresponding to remaining average grayscale values, excluding the average grayscale value that is set to be the reference power source voltage, to calculate a compensation current and generates an equivalent model of the first to third subpixels to calculate a resistance value of an equivalent resistor, thereby calculating the first and second voltage drops of the first and the second power source voltages; and a power source voltage calculator to reflect the first and second voltage drops to the reference power source voltage to calculate a predicted value of the second power source voltage.

3. The organic light emitting diode (OLED) display of claim 2, further comprising a lookup table storing an average grayscale value for each region for the first to third image data.

4. The organic light emitting diode (OLED) display of claim 2, further comprising a lookup table storing the saturation voltage values of the second power source voltage for each grayscale for the first to third image data.

5. The organic light emitting diode (OLED) display of claim 2, further comprising a third lookup table storing a current value for each grayscale for the first to third image data.

6. The organic light emitting diode (OLED) display of claim 2, wherein the equivalent model includes:

a first equivalent organic light emitting diode (OLED) corresponding to a first OLED of the first subpixel, the first OLED emitting light of the first color according to the first image data;

a second equivalent organic light emitting diode (OLED) corresponding to a second OLED of the second subpixel, the second OLED emitting light of the second color according to the second image data;

a third equivalent organic light emitting diode (OLED) corresponding to a third OLED of the third subpixel, the third OLED emitting light of the third color according to the third image data;

first to third equivalent driving transistors corresponding to first to third driving transistors of the first to third subpixels, respectively, the first to third driving transistors respectively driving the first to third organic light emitting diodes (OLED);

a top equivalent resistor corresponding to a resistor of the first power source voltage application line, the top equivalent resistor commonly connected to the first to third equivalent driving transistors; and a bottom equivalent resistor corresponding to a resistor of the second power source voltage application line, the bottom equivalent resistor commonly connected to the first to third equivalent organic light emitting diodes (OLED).

7. The organic light emitting diode (OLED) display of claim 6, wherein the voltage drop calculator calculates the ratio of the current that is a sum of the second to fourth currents flowing when the first to third organic light emitting diodes (OLED) respectively emit light having the first grayscale value to the first current flowing when the first to third organic light emitting diodes (OLED) simultaneously emit light with the first grayscale value as a top voltage drop ratio by the top equivalent resistor.

8. The organic light emitting diode (OLED) display of claim 7, wherein the voltage drop calculator calculates the first to third driving currents by multiplying the top voltage drop ratio by the second to fourth currents and calculates a resistance value of the bottom equivalent resistor using the saturation voltage values of the second power source voltage respectively corresponding to the first to third driving currents, and the first to third driving currents.

9. The organic light emitting diode (OLED) display of claim 8, wherein the voltage drop calculator divides a voltage value that is equivalent to the saturation voltage value of the second power source voltage corresponding to the first grayscale subtracted from a highest saturation voltage value among the saturation voltage values of the second power source voltage respectively corresponding to the first to third driving currents by a sum of the remaining driving currents excluding the driving current corresponding to the highest saturation voltage value among the first to third driving currents to calculate a resistance value of the bottom equivalent resistor.

10. The organic light emitting diode (OLED) display of claim 8, wherein the voltage drop calculator multiples the compensation current and the resistance value of the bottom equivalent resistor to calculate the second voltage drop by the bottom equivalent resistor.

11. The organic light emitting diode (OLED) display of claim 10, wherein the voltage drop calculator calculates a total voltage drop value by multiplying the top voltage drop ratio by the second voltage drop by the bottom equivalent resistor.

12. The organic light emitting diode (OLED) display of claim 11, wherein the voltage drop calculator calculates a voltage that is decreased by the total voltage drop value to the reference power source voltage as a predicted value of the second power source voltage.

13. A method of driving an organic light emitting diode (OLED) display including a plurality of data lines, a plurality of scan lines, and a plurality of pixels connected to a corresponding data line, a corresponding scan line, a first power source voltage application line, and a second power source voltage application line, wherein the plurality of pixels respectively include first to third subpixels emitting light according to first image data displaying a first color, second image data displaying a second color, and third image data displaying a third color, the method comprising;

sensing the second power source voltage and applying the second power source voltage to the second power source voltage application line;

calculating a reference power source voltage corresponding to a maximum average grayscale using a distribution of each grayscale of the first to third image data;

modeling a first voltage drop of the first power source voltage and a second voltage drop of the second power source voltage for the first to third subpixels; and reflecting the first and second voltage drops to the reference power source voltage to change the second power source voltage, wherein modeling the first and second voltage drops includes calculating the first and second voltage drops of the first and second power source voltages, and wherein calculating the first and second voltage drops includes calculating a ratio of a current sum of second to fourth currents flowing respectively through the first to third subpixels when the first to third subpixels respectively emit light with a first grayscale to a first current flowing through the first to third subpixels when the first to third subpixels simultaneously emit light with the first grayscale.

14. The method of claim 13, wherein calculating the reference power source voltage includes:

dividing a total grayscale number of the first to third image data into a plurality of regions;

calculating an average grayscale value for each region for the first to third image data;

calculating the saturation voltage values of the second power source voltage respectively corresponding to the average grayscale value; and setting a lowest value among the saturation voltage values as the reference power source voltage.

15. The method of claim 14, wherein modeling the first and second voltage drops further includes:

calculating a compensation current by adding currents corresponding to remaining average grayscale values, excluding the average grayscale value that is set as the reference power source voltage; and generating an equivalent model including top and bottom equivalent resistors of the first to third subpixels, the top and bottom equivalent resistors corresponding to resistors of the first and second power source voltage application lines, wherein calculating the first and second voltage drops of the first and second power source voltages is performed by calculating resistance values of the top and bottom equivalent resistors for the equivalent model.

16. The method of claim 15, wherein the top equivalent resistor is commonly coupled to first to third equivalent driving transistors of the equivalent model of the first to third subpixels, the first to third equivalent driving transistors corresponding to first to third driving transistors of the first to third subpixels, respectively, and the bottom equivalent resistor is commonly coupled to first to third equivalent organic light emitting diodes (OLEDs) of the equivalent model of the first to third subpixels, the first to third equivalent OLEDs corresponding to first to third OLEDs, respectively, and calculating the first and second voltage drops further includes:

calculating the ratio of the current sum of the second to fourth currents flowing when first to third subpixels respectively emit light with the first grayscale to the first current flowing when the first to third subpixels simultaneously emit light with the first grayscale as a top voltage drop ratio by the top equivalent resistor.

17. The method of claim 16, wherein calculating the first and second voltage drops further includes:

multiplying the top voltage drop ratio by the second to fourth currents to respectively calculate the first to third driving currents;

calculating the saturation voltage value of the second power source voltage respectively corresponding to the first to third driving currents; and dividing a voltage that is equivalent to the saturation voltage value of the second power source voltage corresponding to the first grayscale subtracted from the highest saturation voltage value among the saturation voltage values of the second power source voltage respectively corresponding to the first to third driving currents by the sum of remaining driving currents excluding a driving current corresponding to the highest saturation voltage value among the first to third driving currents to calculate the resistance value of the bottom equivalent resistor.

18. The method of claim 17, wherein calculating the first and second voltage drops further includes:

multiplying the compensation current and the resistance value of the bottom equivalent resistor to calculate the second voltage drop by the bottom equivalent resistor; and multiplying the top voltage drop ratio to the second voltage drop value by the bottom equivalent resistor to calculate a total voltage drop value.

19. The method of claim 18, wherein changing the second power source voltage includes:

calculating a voltage that is decreased by the total voltage drop value to the reference power source voltage as a predicted value of the second power source voltage and reflecting the predicted value to the sensed second power source voltage.

* * * * *